US005956948A

United States Patent [19]

Nagashima et al.

[11] Patent Number: 5,956,948

[45] Date of Patent: Sep. 28, 1999

[54] EXHAUST GAS-PURIFYING SYSTEM FOR INTERNAL COMBUSTION ENGINES

[75] Inventors: Keiichi Nagashima; Yoshio Maeda; Nobuaki Takaoka, all of Wako, Japan

[73] Assignee: Honda Giken Kogyo Kabushiki Kaisha, Tokyo, Japan

[21] Appl. No.: 09/094,576

[22] Filed: Jun. 12, 1998

[30] Foreign Application Priority Data

Jun. 16, 1997 [JP] Japan ..... 9-172756

[51] Int. Cl.[6] ..... F01N 3/00

[52] U.S. Cl. ..... 60/297; 60/277; 60/301; 60/290; 60/285; 123/435

[58] Field of Search ..... 60/276, 277, 285, 60/287, 290, 301; 123/435; 73/117.3, 116

[56] References Cited

U.S. PATENT DOCUMENTS 5,592,919 1/1997 Morikawa ..... 123/435
5,636,614 6/1997 Morikawa ..... 123/435
5,740,669 4/1998 Kinugasa et al. ..... 60/285

FOREIGN PATENT DOCUMENTS 7-139340 5/1995 Japan .

*Primary Examiner*—F. Daniel Lopez
*Assistant Examiner*—Binh Tran
*Attorney, Agent, or Firm*—Nikaido, Marmelstein, Murray & Oram LLP

[57] ABSTRACT

An exhaust gas-purifying system for an internal combustion engine comprises an exhaust gas-purifying device arranged in the exhaust system of the engine and accommodating a nitrogen oxide absorbent for absorbing nitrogen oxides in exhaust gases emitted from the engine when the engine operates in a state where the air-fuel ratio of the exhaust gases is leaner than a stoichiometric air-fuel ratio. A cylinder internal pressure sensor detects pressure within at least one of the cylinders of the engine. The amount of nitrogen oxides generated within the engine is determined based on the pressure within the at least one of the cylinders. It is determined whether the amount of nitrogen oxides absorbed by the nitrogen oxide absorbent has been saturated, based on the determined amount of nitrogen oxides.

7 Claims, 6 Drawing Sheets

KCMDRR MAP

EXHAUST GAS-PURIFYING SYSTEM FOR INTERNAL COMBUSTION ENGINES

BACKGROUND OF THE INVENTION

1. Field of the Invention

This invention relates to an exhaust gas-purifying system for internal combustion engines, and more particularly to an exhaust gas-purifying system of this kind which has an exhaust gas-purifying device with an absorbent arranged in the exhaust system of the engine, for absorbing nitrogen oxides in exhaust gases emitted from the engine.

2. Prior Art

When an internal combustion engine operates in a condition where the air-fuel ratio of a mixture supplied to the engine is set to a leaner value than a stoichiometric air-fuel ratio to carry out so-called lean-burn control, it is likely that an increased amount of nitrogen oxides (hereinafter referred to as "NOx") is emitted from the engine. To overcome this disadvantage, conventionally an exhaust gas-purifying device with a NOx absorbent is arranged in the exhaust system of the engine, for absorbing NOx in exhaust gases emitted from the engine, to thereby carry out purification of exhaust gases emitted from the engine. The NOx absorbent has such a characteristic that it absorbs NOx when the air-fuel ratio is leaner than the stoichiometric air-fuel ratio and accordingly the concentration of oxygen present in exhaust gases is relatively high, i.e. the amount of NOx is large (hereinafter referred to as "the exhaust gas lean state"), whereas it desorbs the absorbed NOx when the air-fuel ratio is richer than the stoichiometric air-fuel ratio and accordingly the concentration of oxygen present in exhaust gases is low, i.e. the amount of HC and CO is large (hereinafter referred to as "the exhaust gas rich state"). Therefore, in the exhaust gas rich state, the exhaust gas-purifying device with the NOx absorbent functions to reduce NOx desorbed from the NOx absorbent to a nitrogen gas by reaction with HC and CO, which is emitted into the air, and oxidize HC and CO into steam and carbon dioxide, which are also emitted into the air.

The NOx absorbent, however, has a limited capacity for absorbing NOx, and therefore the lean-burn control cannot be continued over a long time period. To cope with this inconvenience, there is conventionally known a method, for example, from Japanese Laid-Open Patent Publication (Kokai) No. 7-139340, which temporarily enriches the air-fuel ratio in order to desorb NOx which has been absorbed by the NOx absorbent, for reduction of the thus desorbed NOx. In the present specification, this temporary enrichment of the air-fuel ratio for desorbing NOx will be referred to as "reduction enrichment".

Japanese Laid-Open Patent Publication (Kokai) No. 7-139340 referred to above also discloses a method of estimating an amount of NOx absorbed by the NOx absorbent to suitably carry out the reduction enrichment. According to the method, an NOx amount-estimating counter is provided for estimating an amount of NOx absorbed by the NOx absorbent, and the count value of the NOx amount-estimating counter is incremented during execution of the lean-burn control, while it is decremented during execution of the reduction enrichment or air-fuel ratio feedback control with the desired air-fuel ratio set to a stoichiometric air-fuel ratio. More specifically, during execution of the lean-burn control, a predetermined addend set according to operating conditions of the engine is added to the count value of the NOx amount-estimating counter at predetermined time intervals, while during execution of the reduction enrichment or the air-fuel ratio feedback control with the desired air-fuel ratio set to the stoichiometric air-fuel ratio, a predetermined subtrahend is subtracted from the count value of the NOx amount-estimating counter at predetermined time intervals. The subtrahend is set according to the temperature of the NOx absorbent and an excess of a fuel amount supplied to the engine during the reduction enrichment in excess of a required fuel amount for obtaining the stoichiometric air-fuel ratio.

The conventional absorbed NOx amount-estimating method, however, does not contemplate the actual pressure within the cylinder and the actual temperature within the cylinder in estimating the absorbed NOx amount, which results in a large error in the estimated absorbed NOx amount. Consequently, timing of starting the reduction enrichment can become earlier or later than the desired timing. As a result, the fuel amount for enriching the air-fuel ratio can be increased to degrade fuel economy is degraded, or the timing of starting the reduction enrichment can be delayed to increase the emission amount of NOx.

SUMMARY OF THE INVENTION

It is the object of the invention to provide an exhaust gas-purifying system for an internal combustion engine having an exhaust gas-purifying device with a NOx absorbent, which is capable of more accurately estimating the amount of NOx absorbed by the NOx absorbent.

To attain the above object, the present invention provides an exhaust gas-purifying system for an internal combustion engine having a plurality of cylinders, and an exhaust system, comprising:

- exhaust gas-purifying means arranged in the exhaust system and accommodating a nitrogen oxide absorbent for absorbing nitrogen oxides in exhaust gases emitted from the engine when the engine operates in a state where an air-fuel ratio of the exhaust gases is leaner than a stoichiometric air-fuel ratio;
- cylinder internal pressure-detecting means for detecting pressure within at least one of the cylinders;
- nitrogen oxide generation amount-determining means for determining an amount of nitrogen oxides generated within the engine, based on the pressure within the at least one of the cylinders; and
- saturation state-determining means for determining whether an amount of nitrogen oxides absorbed by the nitrogen oxide absorbent has been saturated, based on the amount of nitrogen oxides determined by the nitrogen oxide generation amount-determining means.

Preferably, the nitrogen oxide generation amount-determining means comprises cylinder-by-cylinder generation amount-determining means for determining an amount of nitrogen oxides generated within each of the cylinders, the nitrogen oxide generation amount-determining means determining the amount of nitrogen oxides generated within the engine, by integrating the amount of nitrogen oxides generated within the each of the cylinders, determined by the cylinder-by-cylinder generation amount-determining means.

More preferably, the cylinder-by-cylinder generation amount-determining means determines the amount of nitrogen oxides generated within the each of the cylinders, by integrating an amount of nitrogen oxides generated within the each of the cylinders in each combustion cycle thereof.

Preferably, the exhaust gas-purifying system includes exhaust gas pressure-detecting means for detecting pressure of exhaust gases emitted from the engine, and exhaust gas temperature-detecting means for detecting temperature of the exhaust gases, the nitrogen oxide generation amount-determining means determining the amount of nitrogen oxides generated within the engine according to the pressure and temperature of the exhaust gases detected by the exhaust gas pressure-detecting means and the exhaust gas temperature-detecting means.

Also preferably, the exhaust gas-purifying system includes exhaust gas pressure-detecting means for detecting pressure of exhaust gases emitted from the engine, and exhaust gas temperature-detecting means for detecting temperature of the exhaust gases, the cylinder-by-cylinder generation amount-determining means determining the amount of nitrogen oxides generated within the each of the cylinders according to the pressure and temperature of the exhaust gases detected by the exhaust gas pressure-detecting means and the exhaust gas temperature-detecting means.

Preferably, the saturation state-determining means compares the amount of nitrogen oxides generated within the engine, determined by the nitrogen oxide generation amount-determining means with a predetermined amount slightly smaller than a maximum amount that the nitrogen absorbent can absorb, and determines that the amount of nitrogen oxides absorbed by the nitrogen oxide absorbent has been saturated when the amount of nitrogen oxides generated within the engine becomes equal to or larger than the predetermined amount.

Advantageously, the exhaust gas-purifying system further includes reduction means for reducing nitrogen oxides absorbed by the nitrogen oxide absorbent, by enriching an air-fuel ratio of a mixture supplied to the engine, the reduction means being operable when the saturation state-determining means determines that the amount of nitrogen oxides absorbed by the nitrogen oxide absorbent has been saturated.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
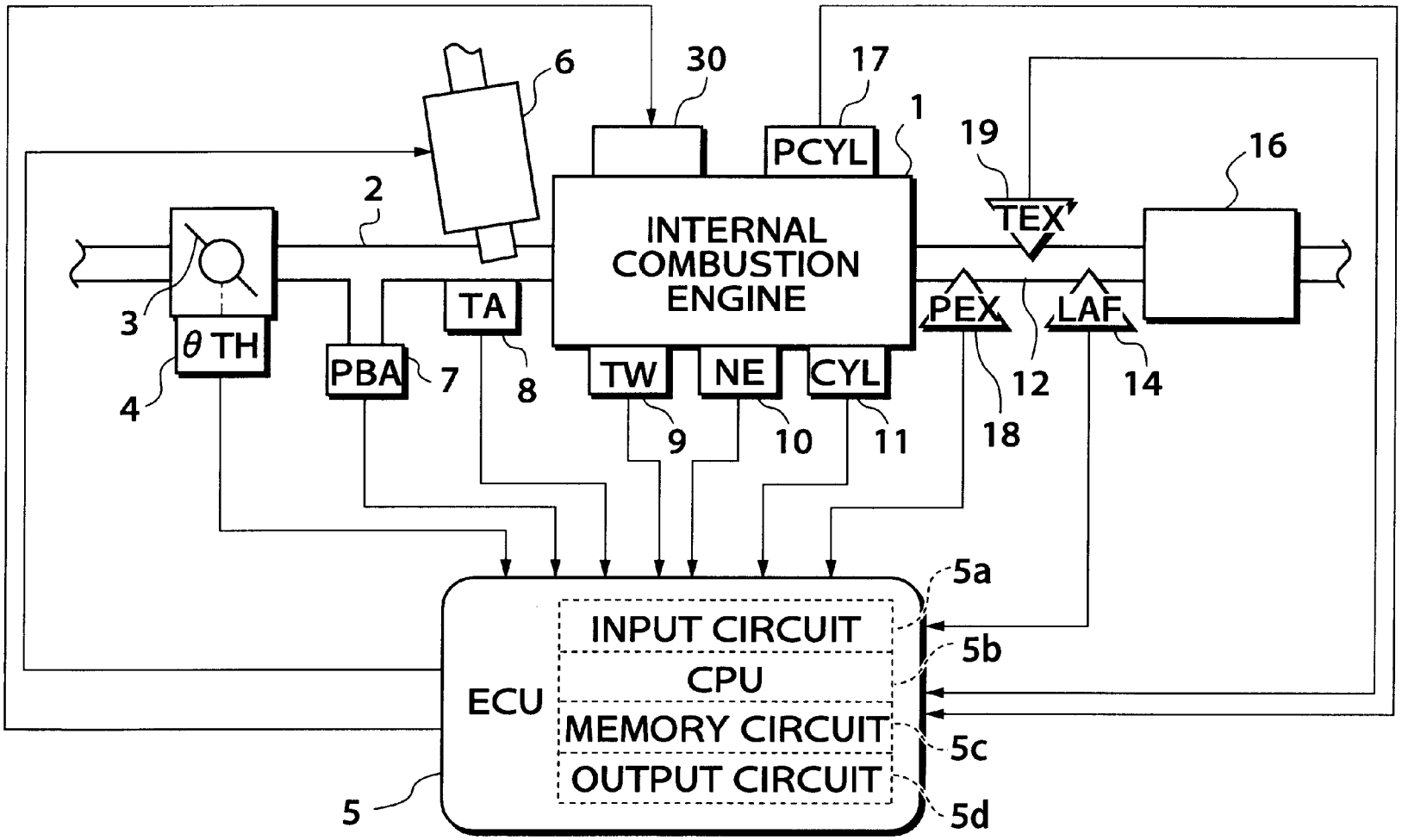
FIG. 1 is a block diagram schematically showing the whole arrangement of an internal combustion engine and an exhaust gas-purifying system therefor, according to an embodiment of the invention.

Referring first to FIG. 1, there is schematically illustrated the whole arrangement of an internal combustion engine and an exhaust gas-purifying system therefor, according to an embodiment of the invention. In the figure, reference numeral 1 designates an internal combustion engine (hereinafter simply referred to as "the engine") having four cylinders, for instance. Connected to the cylinder block of the engine 1 is an intake pipe 2 in which is arranged a throttle valve 3. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5 for controlling the engine.

Fuel injection valves 6, only one of which is shown, are each provided for each cylinder and arranged in the intake pipe 2 at a location intermediate between the engine 1 and the throttle valve 3 and slightly upstream of an intake valve, not shown. The fuel injection valves 6 are connected to a fuel pump, not shown, and electrically connected to the ECU 5 to have their valve opening periods controlled by signals therefrom.

Further, an intake pipe absolute pressure (PBA) sensor 7 is provided in communication with the interior of the intake pipe 2, at a location immediately downstream of the throttle valve 3, for supplying an electric signal indicative of the sensed absolute pressure PBA within the intake pipe 2 to the ECU 5. An intake air temperature (TA) sensor 8 is inserted into the interior of the intake pipe 2 at a location downstream of the PBA sensor 7, for supplying an electric signal indicative of the sensed intake air temperature TA to the ECU 5.

An engine coolant temperature (TW) sensor 9 formed of a thermistor or the like is mounted in the cylinder block, for supplying an electric signal indicative of the sensed engine coolant temperature TW to the ECU 5.

An engine rotational speed (NE) sensor 10 and a cylinder-discriminating (CYL) sensor 11 are arranged in facing relation to a camshaft or a crankshaft of the engine 1, neither of which is shown. The NE sensor 10 generates a TDC signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder. The CYL sensor 11 generates a signal pulse at a predetermined crank angle of a particular cylinder of the engine 1, these signal pulses being supplied to the ECU 5.

An exhaust gas-purifying device 16 is arranged in an exhaust pipe 12 connected to the cylinder block of the engine 1, for purifying exhaust gases emitted from the engine. The exhaust gas-purifying device 16 accommodates a NOx absorbent for absorbing nitrogen oxides (NOx) and a catalyst for performing oxidation and reduction of HC, CO, and NOx. The NOx absorbent has such a characteristic that it absorbs NOx when the air-fuel ratio of a mixture supplied to the engine 1 is leaner than a stoichiometric air-fuel ratio and accordingly the concentration of oxygen present in exhaust gases is relatively high, i.e. the amount of NOx is large (in the exhaust gas lean state), whereas it desorbs absorbed NOx when the air-fuel ratio is richer than the stoichiometric air-fuel ratio and accordingly the concentration of oxygen present in exhaust gases is low, i.e. the amount of HC and Co is large (in the exhaust gas rich state). The exhaust gas-purifying device 16 functions in the exhaust gas lean state to absorb NOx into the NOx absorbent. On the other hand, the exhaust gas-purifying device 16 functions in the exhaust gas rich state to reduce NOx desorbed from the NOx absorbent to a nitrogen gas by reaction with HC and CO, which is emitted into the air, and oxidize HC and CO into steam and $CO_2$, which are also emitted into the air. The NOx absorbent is formed, e.g. of barium oxide (BaO), and the catalyst is formed, e.g. of platinum (Pt). The NOx absorbent has such a characteristic that it more easily desorbs the absorbed NOx as the temperature thereof rises. The NOx absorbent desorbs NOx even in the exhaust gas lean state if the oxygen concentration lowers so that the generation amount of NOx decreases.

As described before, however, once the NOx absorbent absorbs NOx to capacity, the absorbent can no more absorb NOx. Therefore, to cause desorbing of NOx for reduction thereof, reduction enrichment of the air-fuel ratio is carried out. In this reduction enrichment, if the degree of enrichment is too small, the desorbed NOx is only reduced to an insufficient degree, whereas if the degree of enrichment is too large, HC and CO are emitted in large amounts. Therefore, the degree of enrichment must be controlled in a manner suitable for operating conditions of the engine so as to maintain good exhaust emission characteristics.

A linear output air-fuel ratio sensor (hereinafter referred to as "the LAF sensor") 14 is arranged in the exhaust pipe 12 at a location upstream of the exhaust gas-purifying device 16, for generating an electric signal almost proportional in value to the concentration of oxygen (air-fuel ratio) present in exhaust gases emitted from the engine and supplying the same to the ECU 5. Further, the exhaust pipe 12 has a manifold part in which an exhaust gas pressure (PEX) sensor 18 and an exhaust gas temperature (TEX) sensor 19 are provided for each cylinder, for detecting pressure PEX of exhaust gases and temperature TEX of exhaust gases, respectively. Signals indicative of the sensed parameter values are supplied to the ECU 5.

Further, a cylinder internal pressure PCYL sensor 17 as cylinder internal pressure-detecting means is inserted into each cylinder of the engine 1, for detecting pressure PCYL within the cylinder, a signal indicative of the sensed cylinder internal pressure PCYL being supplied to the ECU 5.

The engine 1 includes a valve timing changeover mechanism 30 which changes valve timing of intake valves and exhaust valves, neither of which is shown, between a high speed valve timing suitable for operation of the engine in a high speed operating region and a low speed valve timing suitable for operation of the engine in a low speed operating region. The valve timing includes the valve lift amount, and further, when the low speed valve timing is selected, one of the two intake valves is disabled, thereby ensuring stable combustion even when the air-fuel ratio of the mixture is controlled to a leaner value than a stoichiometric air-fuel ratio.

The valve timing changeover mechanism 30 changes the valve timing by means of hydraulic pressure, and an electromagnetic valve for changing the hydraulic pressure and a hydraulic pressure sensor, neither of which is shown, are electrically connected to the ECU 5. A signal indicative of the sensed hydraulic pressure is supplied to the ECU 5 which in turn controls the electromagnetic valve to change the valve timing according to operating conditions of the engine.

The ECU 5 is comprised of an input circuit 5*a* having the functions of shaping the waveforms of input signals from various sensors including ones mentioned above, shifting the voltage levels of sensor output signals to a predetermined level, converting analog signals from analog-output sensors to digital signals, and so forth, a central processing unit (hereinafter referred to as the "the CPU") 5*b*, a memory circuit 5*c* storing various operational programs which are executed by the CPU 5*b*, and tables and maps employed therein, and for storing results of calculations therefrom, etc., and an output circuit 5*d* which outputs driving signals to the fuel injection valves 6, etc.

The CPU 5*b* operates in response to the above-mentioned various engine parameter signals from the various sensors to determine operating conditions in which the engine 1 is operating, such as an air-fuel ratio feedback control region, and open-loop control regions other than the air-fuel ratio feedback control region, and calculates, based upon the determined engine operating conditions, a fuel injection period TOUT over which each fuel injection valve 6 is to be opened by the use of the following equation (1), in synchronism with generation of TDC signal pulses:

$$TOUT=TI\times KCMDM\times KLAF\times K1+K2 \quad (1)$$

where TI represents a basic value of the fuel injection period TOUT of the fuel injection valve 6, which is determined according to the engine rotational speed NE and the intake pipe absolute pressure PBA.

KCMDM represents a final desired air-fuel ratio coefficient which is obtained by effecting a fuel cooling-dependent correction on a desired air-fuel ratio coefficient KCMD which is determined according to engine operating parameters, such as the engine rotational speed NE, the intake pipe absolute pressure PBA, and the engine coolant temperature TW, as described hereinafter. The KCMD value is proportional to the reciprocal of the air-fuel ratio A/F, i.e. the fuel-air ratio F/A, and set to 1.0 when the air-fuel ratio assumes the stoichiometric value. Therefore, the KCMD value will be also referred to as the desired equivalent ratio.

KLAF represents an air-fuel ratio correction coefficient which is calculated through PID control such that a detected equivalent ratio KACT determined in response to an output from the LAF sensor 14 becomes equal to the desired equivalent ratio KCMD.

K1 and K2 represent other correction coefficients and correction variables, respectively, which are set according to engine operating parameters to such values as optimize operating characteristics of the engine, such as fuel consumption and engine accelerability.

The CPU 5*b* supplies driving signals to the fuel injection valves 6 via the output circuit 5*d*, to open the same over the fuel injection period TOUT obtained by the above calculation.

Figure 2:
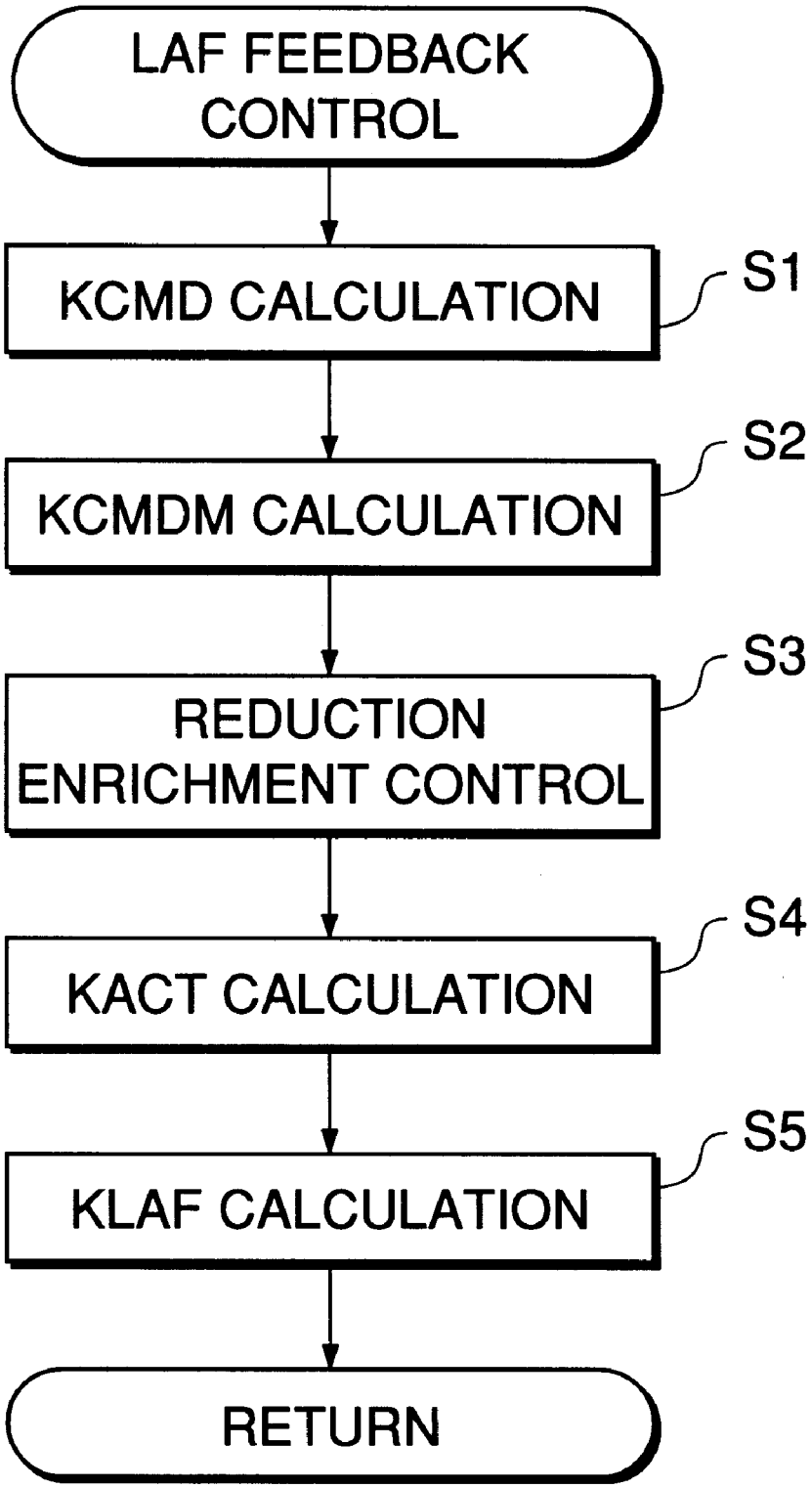
FIG. 2 is a flowchart showing a main routine for carrying out air-fuel ratio feedback control in response to an output from an air-fuel ratio sensor appearing in FIG. 1.

FIG. 2 shows a main routine for calculating the air-fuel ratio correction coefficient KLAF by determining the desired equivalent ratio KCMD and carrying out the PID control such that the detected equivalent ratio KACT becomes equal to the desired equivalent ratio KCMD. This routine is executed in synchronism with generation of, e.g. TDC signal pulses.

First, at a step S1, the desired equivalent ratio KCMD is determined. The KCMD value is basically determined according to the engine rotational speed NE and the intake pipe absolute pressure PBA, and when the engine 1 is in a condition of low engine coolant temperature TW or in a predetermined high load condition, the KCMD value is set to a value according to the condition.

At a step S2, the fuel cooling-dependent correction is effected on the desired equivalent ratio KCMD, to thereby calculate the final desired air-fuel ratio coefficient KCMDM, by the use of the following equation (2):

$$KCMDM=KCMD\times KETC \quad (2)$$

where KETC represents a fuel cooling-dependent correction coefficient which is set to a larger value as the KCMD value increases. The fuel cooling-dependent correction is carried out in view of the fact that the fuel cooling effect due to fuel injection becomes larger as the KCMD value increases and hence the fuel injection amount increases.

Figure 3:
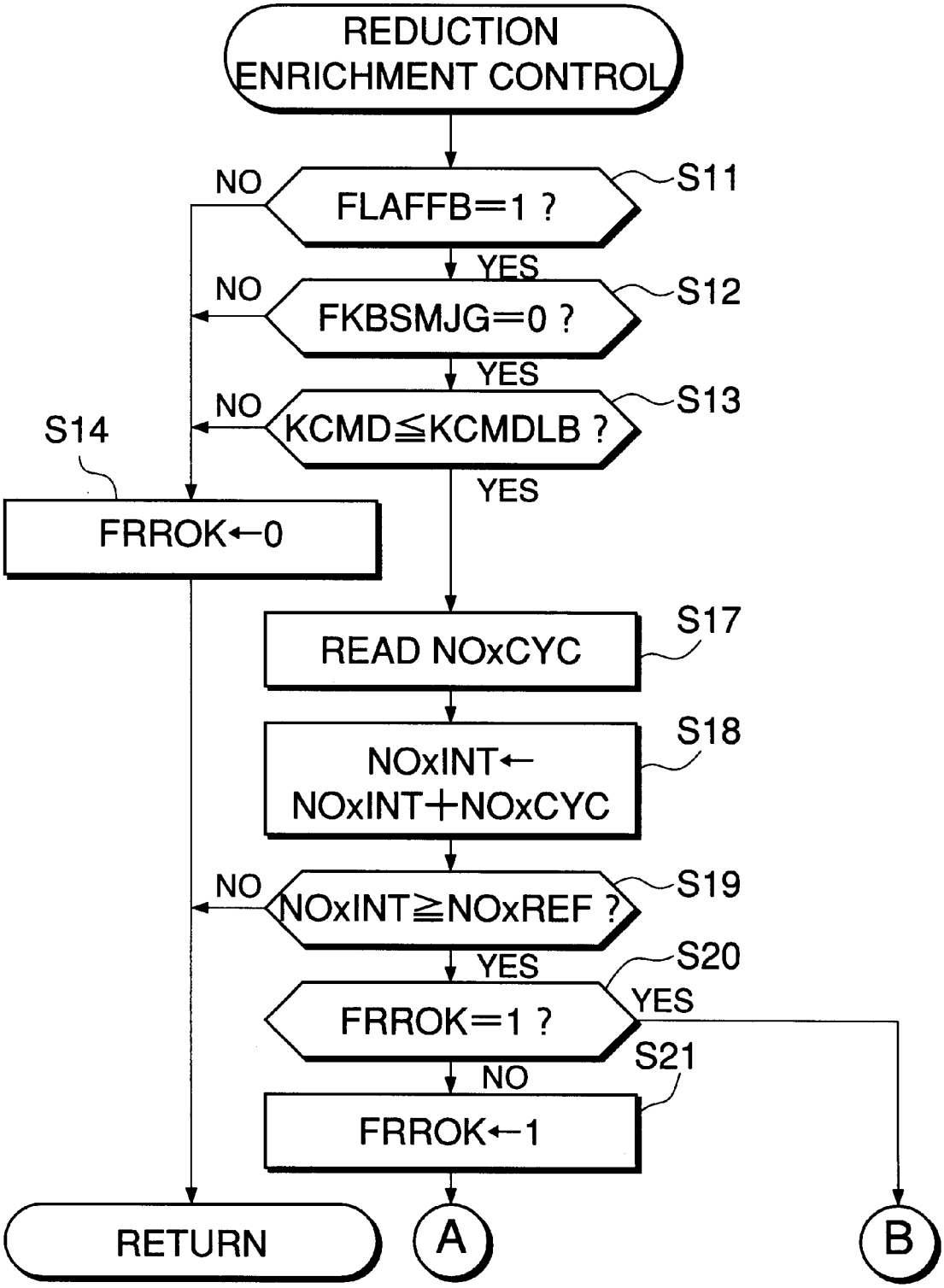
FIG. 3 is a flowchart showing a subroutine for carrying out reduction enrichment, which is executed at a step S3 in FIG. 2.
Figure 4:
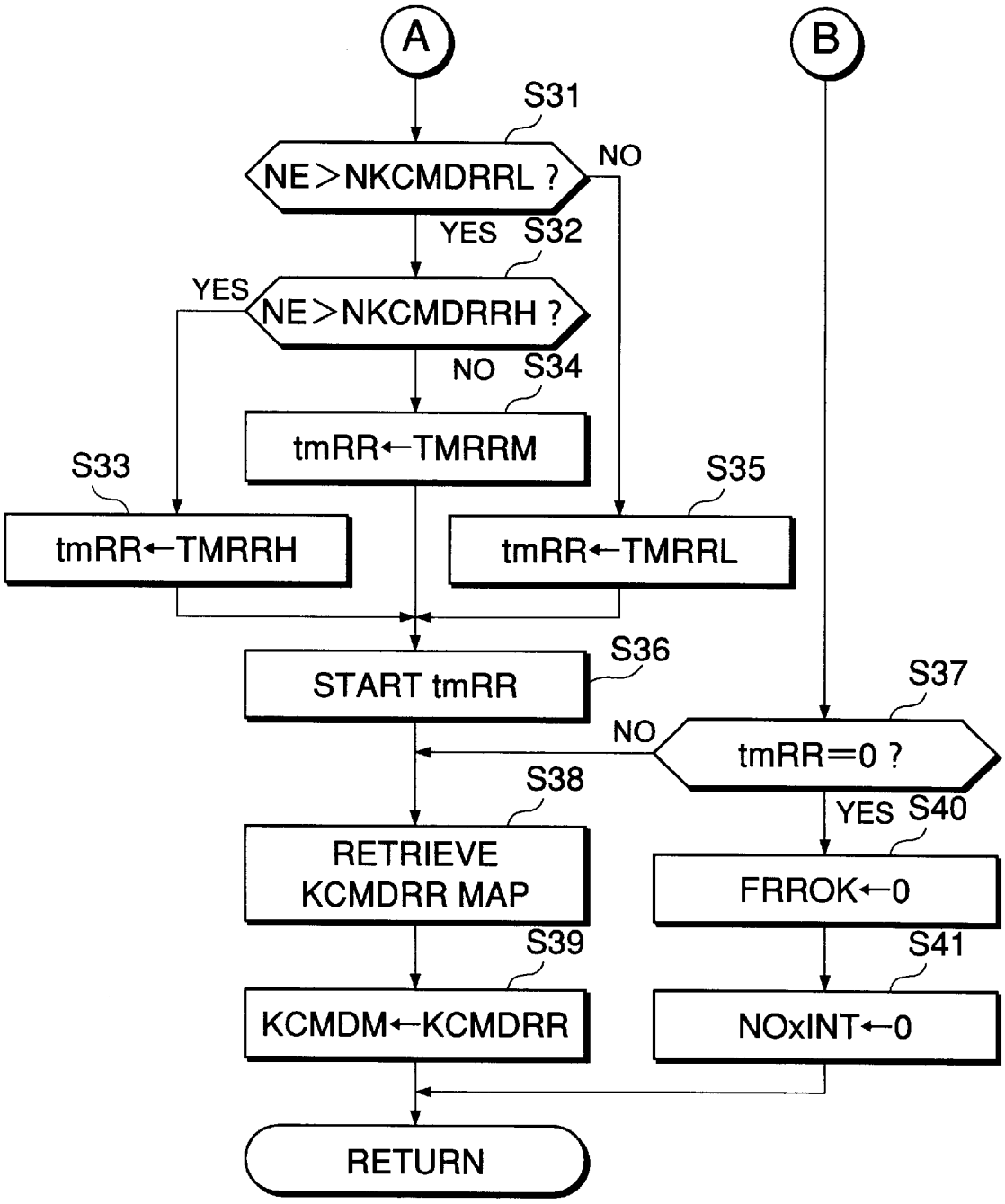
FIG. 4 is a continued part of the flowchart of FIG. 3.

At a step S3, a reduction enrichment control process of FIGS. 3 and 4 is carried out, and at a step S4, the output from the LAF sensor 14 is converted into the equivalent ratio, to calculate the detected equivalent ratio KACT. At the following step S5, the PID control is carried out based on the difference between the detected equivalent ratio KACT and the desired equivalent ratio KCMD, to calculate the air-fuel ratio correction coefficient KLAF such that the detected equivalent ratio KACT becomes equal to the desired equivalent ratio KCMD.

FIGS. 3 and 4 show a subroutine for carrying out the reduction enrichment control process executed at the step S3 in FIG. 2.

First, at a step S11, it is determined whether or not a feedback control flag FLAFFB is equal to "1". The flag FLAFFB, when set to "1", indicates that the engine 1 is in the air-fuel ratio feedback control region in which the air-fuel ratio feedback control is to be carried out in response to the output from the LAF sensor 14. If FLAFFB=1 holds, which means that the engine 1 is in the feedback control region, it is determined at a step S12 whether or not a lean-burn control flag FKBSMJG is equal to "0". The flag FKBSMJG, when set to "0", indicates that the engine 1 is in a lean-burn control region in which the air-fuel ratio is set to a value leaner than the stoichiometric value. If FKBSMJG=0 holds, which means that the engine 1 is in the lean-burn control region, it is determined at a step S13 whether or not the desired equivalent ratio KCMD is equal to or smaller than a predetermined equivalent ratio KCMDLB (e.g. 0.98) which is set to a slightly leaner value than the stoichiometric value.

If any of the answers to the questions of the steps S11 to S13 is negative (NO), a reduction enrichment flag FRROK which, when set to "1", indicates that the reduction enrichment is being carried out is set to "0" at a step S14, followed by terminating the present routine without carrying out the reduction enrichment.

Figure 6:
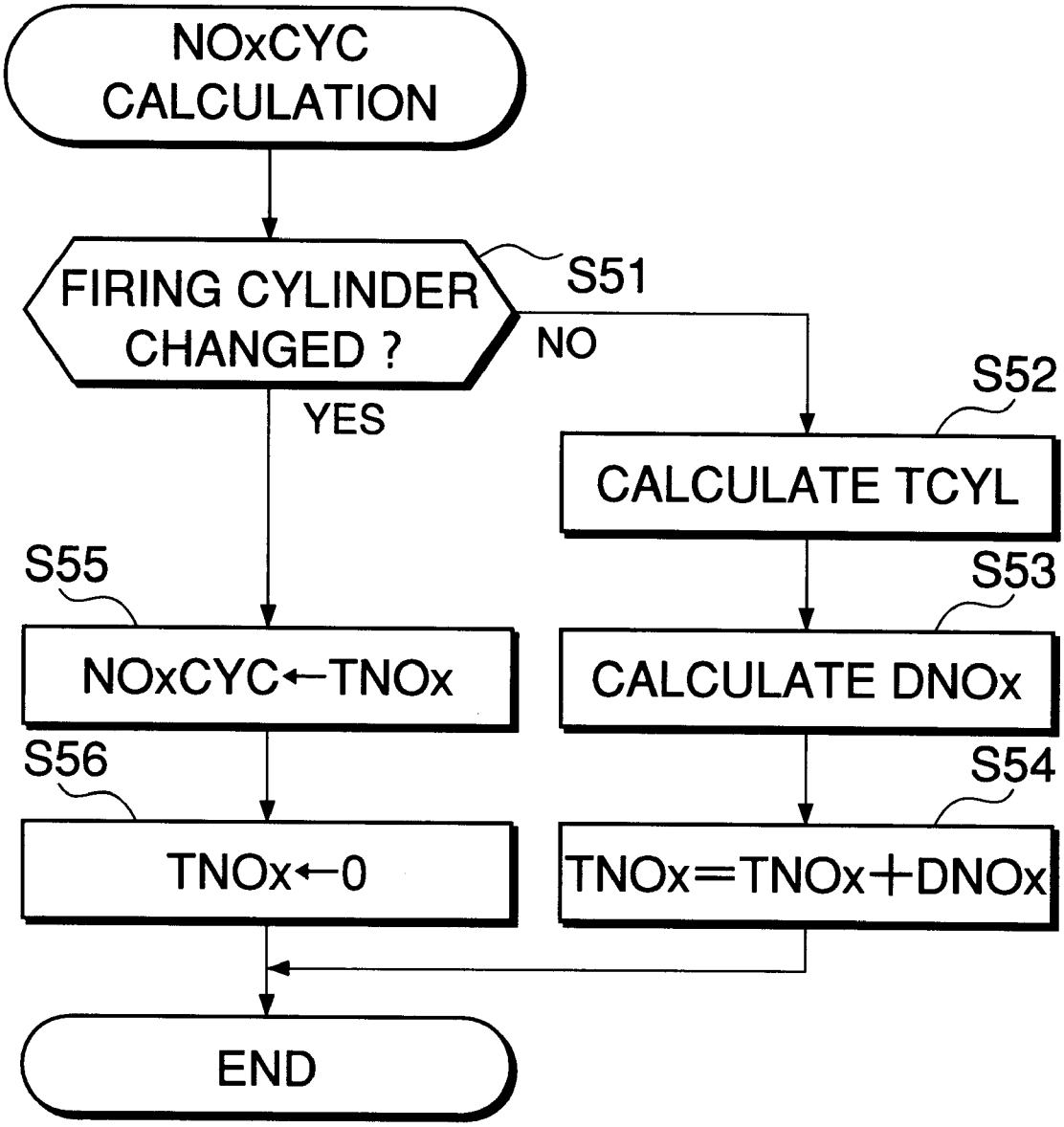
FIG. 6 is a flowchart showing a subroutine for calculating a NOx generation amount NOxCYC, which is executed at a step S17 in FIG. 3.

On the other hand, if the answers to the questions of the steps S11 to S13 are all affirmative (YES), which means that the lean-burn control can be carried out, a NOx generation amount NOxCYC calculated by a subroutine of FIG. 6 is read in at a step S17.

FIG. 6 shows the subroutine for calculating the NOx generation amount NOxCYC, which is executed by the CPU **5*b*** whenever the crankshaft rotates through one degree, for example.

First, at a step S51, it is determined whether or not a firing cylinder, i.e. a cylinder in the combustion period from ignition to termination of firing, has changed. If the firing cylinder has not changed, temperature within the firing cylinder TCYL (°K) is calculated by the use of the following equatior representative of the Boyle-Charles' law at a step S52:

$$TCYL=PCYL\cdot VCYL/mR \tag{3}$$

where VCYL represents the volume of the combustion chamber of the firing cylinder, which is determined by the crank angle, R a gas constant, and m the number of moles of the gas. The number of moles m is determined by retrieving a map which is set according to the exhaust gas pressure PEX and the exhaust gas temperature TEX, in response to outputs from the exhaust gas pressure PEX sensor 18 and the exhaust gas temperature TEX sensor 19, which correspond to the firing cylinder. This is because a change in the volumetric efficiency $\eta V$ can be detected from the exhaust gas pressure PEX and the exhaust gas temperature TEX.

Then, at a step S53, a NOx generation amount per one degree of crankshaft rotation (hereinafter referred to as "the unit generation amount") DNOx is calculated by the use of the following equation (4) which simulates the Extended Zeldvich NOx Formation Model:

$$DNOx = \frac{KCYL\cdot TCYL\cdot \exp(58{,}300/TCYL)}{NE\cdot PCYL^{1/2}} \tag{4}$$

where NE represents the engine rotational speed, and KCYL an empirically determined proportional constant.

Then, at a step S54, an accumulated or integrated value TNOx of the NOx generation amount is calculated by accumulating or integrating the unit generation amount DNOx.

In a strict sense, the above equation (4) is for calculating the generation amount of NO present in NOx. The amount of NO2 generated in the cylinder of the engine, however, is negligibly small compared with the generation amount of NO, and therefore the DNOx amount calculated by the above equation (4) can be regarded as the NOx generation amount.

The Extended Zeldvich NOx Formation Model is for determining in which direction reaction of ingredients in exhaust gases (NOx and components causing NOx generation by reaction) progresses according to the exhaust gas temperature, and for determining approximately the NOx generation amount, based on the exhaust gas temperature and exhaust gas pressure assumed during the reaction. The Extended Zeldvich NOx Formation Model is described in, for example, "Experimental and Theoretical Investigation of Nitric Oxide Formation in Internal Combustion Engines" Combust. Sci. Technol., vol. 1, pp. 313–326, 1970.

If the answer to the question of the step S51 becomes affirmative (YES), which means that the firing cylinder has changed, the NOx generation amount NOxCYC is set to the integrated value TNOx at a step S55, and the integrated value TNOx is reset to "0" at a step S56, followed by terminating the present routine.

Referring again to FIG. 3, at a step S18, the NOx generation amount NOxCYC read in at the step S17 is integrated by the use of the following equation (5), to thereby calculate the integrated NOx amount NOxINT:

$$NOxINT=NOxINT+NOxCYC \tag{5}$$

Then, it is determined at a step S19 whether or not the integrated NOx amount NOxINT is equal to or larger than a predetermined amount NOxREF. So long as NOxINT<NOxREF holds, the program is immediately terminated without execution of the reduction enrichment. On this occasion, the lean-burn control is carried out based on the final desired air-fuel ratio KCMCM which has been set to a value suitable for the lean-burn control (e.g. a value corresponding to A/F=22) at the step S2 in FIG. 2. The predetermined amount NOxREF is set to a value slightly smaller than the maximum amount of NOx that the NOx absorbent of the exhaust gas-purifying device 16 can absorb.

If NOxINT≧NOxREF holds at the step S19, the program proceeds to a step S20 to carry out the reduction enrichment. At the step S20, it is determined whether or not the reduction enrichment flag FRROK is equal to "1". When this question is first made, FRROK=0 holds, and then the flag FRROK is set to "1" at a step S21. Then, it is determined at a step S31 whether or not the engine rotational speed NE is higher than a first predetermined value NKCMDRRL (e.g. 1000 rpm). If NE>NKCMDRRL holds, it is determined at a step S32 whether or not the engine rotational speed NE is higher than a second predetermined value NKCMDRRH (e.g. 2000 rpm) which is higher than the first predetermined value NKCMDRRL. If NE≦KCMDRRL holds, which means that the engine is in a low rotational speed region, a down-counting timer tmRR is set to a predetermined value TMRRL (e.g. 300 msec) suitable for the low rotational speed region at a step S35. If NKCMDRRL<NE≦NKCMDRRH holds, which means that the engine is in an intermediate rotational speed region, the timer tmRR is set to a predetermined value TMRRM (e.g. 500 msec) suitable for the intermediate rotational speed region and longer than the value TMRRL at a step S34. On the other hand, if NE>NKCMDRRH holds, which means that the engine is in a high rotational speed region, the timer tmRR is set to a predetermined value TMRRH (e.g. 800 msec) suitable for the high rotational speed region and longer than the value TMRRM at a step S33. Following the execution of the step S33, S34 or S35, the program proceeds to a step S36.

Figure 5:
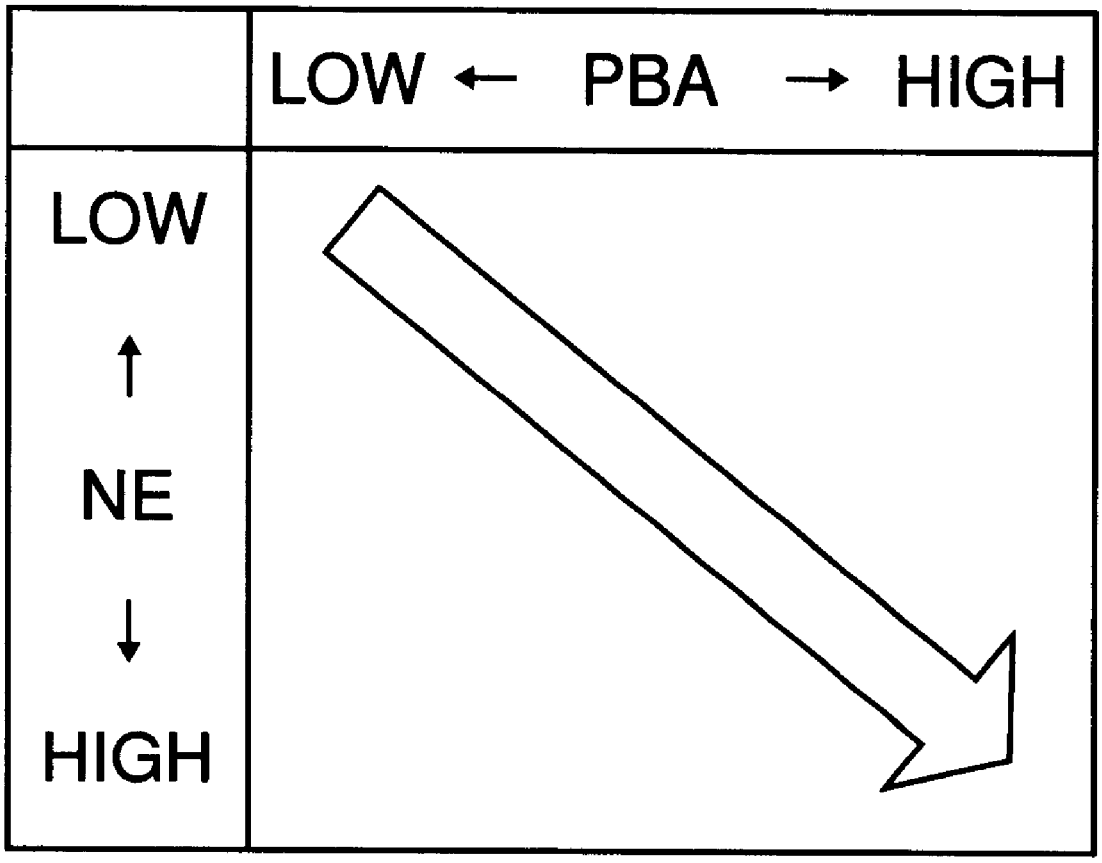
FIG. 5 shows a KCMDRR map used in the FIG. 4 routine.

At the step S36, the timer tmRR which has been set at the step S33, S34 or S35 is started. Then, a KCMDRR map of FIG. 5 is retrieved to determine a reduction enrichment desired equivalent ratio KCMDRR at a step S38, and the final desired air-fuel ratio coefficient KCMDM is set to the reduction enrichment desired equivalent ratio KCMDRR at a step S39, followed by terminating the present routine.

The KCMDRR map is set such that the reduction enrichment desired equivalent ratio KCMDRR is determined according to the engine rotational speed NE and the intake pipe absolute pressure PBA. More specifically, the KCMDRR value is set to a lager value as the engine rotational speed NE increases and/or the intake pipe absolute pressure PBA increases. All the map values of the KCMDRR value are set to larger values than 1.0 (a value corresponding to A/F=14.7).

If the reduction enrichment flag FRROK is set to "1" to start the reduction enrichment at the step S21, in the following loop of execution of this routine, the answer to the question of the step S20 becomes affirmative (YES), and then the program proceeds to a step S37, wherein it is determined whether or not the count value of the timer tmRR is equal to "0". When this question is first made, tmRR>0 holds, and then the program proceeds to the step S38. On the other hand, if tmRR=0 holds at the step S37, the reduction enrichment flag FRROK is set to "0" at a step S40, and the integrated NOx amount NOxINT is reset to "0" at a step S41, followed by terminating the reduction enrichment. When the steps S40 and S41 are executed, the final desired air-fuel ratio coefficient KCMDM is held at the value calculated at the step S2 in FIG. 2, and therefore the lean-burn control is started again.

Thereafter, the answer to the question at the step S19 becomes negative (NO), and therefore the lean-burn control is continuously carried out. If NOxINT≧tNOxREF holds, the reduction enrichment is started.

As described in detail hereinabove, according to the present embodiment, the cylinder internal pressure PCYL is detected for each cylinder, and the NOx generation amount NOxCYC for one combustion cycle of each cylinder is calculated based on the detected cylinder internal pressure PCYL, followed by integration of the NOx generation amount NOxCYC thus calculated, to thereby obtain the integrated NOx amount NOxINT. When the integrated NOx amount NOxINT reaches the predetermined value NOxREF almost equal to the maximum absorption amount of the NOx absorbent of the exhaust gas-purifying device 16, it is determined that the NOx amount absorbed by the NOx absorbent has been saturated. Therefore, the NOx amount absorbed by the NOx absorbent can be more accurately estimated than in the conventional method, which makes it possible to accurately determine a NOx amount saturation state of the NOx absorbent. As a result, the reduction enrichment can be started at appropriate timing, which leads to prevention of degraded fuel economy and increased NOx emission amount.

The present invention is not limited to the embodiment described above but various modifications thereof are possible. For instance, although in the above described embodiment, the cylinder internal pressure sensor 17 is provided for each of the four cylinders of the engine 1, a single cylinder internal pressure sensor 17 may be provided for a particular one of the cylinders. In such a case, immediately after termination of the combustion period of the particular cylinder, the NOx generation amount NOxCYC per combustion cycle is calculated based on the detected cylinder internal pressure PCYL, and immediately after termination of the combustion period of any of firing cylinders other than the particular cylinder, the above calculated NOx generation amount NOxCYC is added as it is, to thereby calculate the integrated NOx amount NOxINT.

Further, in the above described embodiment, the exhaust gas pressure (PEX) sensor 18 and the exhaust gas temperature (TEX) sensor 19 are arranged in the manifold part of the exhaust pipe 12 for each of the four cylinders, this is not limitative. Alternatively, a single exhaust gas pressure sensor 18 and a single exhaust gas temperature sensor 19 may be arranged in a confluent portion of the exhaust pipe 12 such that outputs from these sensors are used in calculation of the NOx generation amount for all the cylinders.

What is claimed is:

1. An exhaust gas-purifying system for an internal combustion engine having a plurality of cylinders, and an exhaust system, comprising:

exhaust gas-purifying means arranged in said exhaust system and accommodating a nitrogen oxide absorbent for absorbing nitrogen oxides in exhaust gases emitted from said engine when said engine operates in a state where an air-fuel ratio of said exhaust gases is leaner than a stoichiometric air-fuel ratio;

cylinder internal pressure-detecting means for detecting pressure within at least one of said cylinders;

nitrogen oxide generation amount-determining means for determining an amount of nitrogen oxides generated within said engine, based on said pressure within said at least one of said cylinders; and saturation state-determining means for determining whether an amount of nitrogen oxides absorbed by said nitrogen oxide absorbent has been saturated, based on said amount of nitrogen oxides determined by said nitrogen oxide generation amount-determining means.

2. An exhaust gas-purifying system as claimed in claim 1, wherein said nitrogen oxide generation amount-determining means comprises cylinder-by-cylinder generation amount-determining means for determining an amount of nitrogen oxides generated within each of said cylinders, said nitrogen oxide generation amount-determining means determining said amount of nitrogen oxides generated within said engine, by integrating said amount of nitrogen oxides generated within said each of said cylinders, determined by said cylinder-by-cylinder generation amount-determining means.

3. An exhaust gas-purifying system as claimed in claim 2, wherein said cylinder-by-cylinder generation amount-determining means determines said amount of nitrogen oxides generated within said each of said cylinders, by integrating an amount of nitrogen oxides generated within said each of said cylinders in each combustion cycle thereof.

4. An exhaust gas-purifying system as claimed in claim 1, including exhaust gas pressure-detecting means for detecting pressure of exhaust gases emitted from said engine, and exhaust gas temperature-detecting means for detecting temperature of said exhaust gases, said nitrogen oxide generation amount-determining means determining said amount of nitrogen oxides generated within said engine according to the pressure and temperature of said exhaust gases detected by said exhaust gas pressure-detecting means and said exhaust gas temperature-detecting means.

5. An exhaust gas-purifying system as claimed in claim 2, including exhaust gas pressure-detecting means for detecting pressure of exhaust gases emitted from said engine, and exhaust gas temperature-detecting means for detecting temperature of said exhaust gases, said cylinder-by-cylinder generation amount-determining means determining said amount of nitrogen oxides generated within said each of said cylinders according to the pressure and temperature of said exhaust gases detected by said exhaust gas pressure-detecting means and said exhaust gas temperature-detecting means.

6. An exhaust gas-purifying system as claimed in any of claims 1 to 4, wherein said saturation state-determining means compares said amount of nitrogen oxides generated within said engine, determined by said nitrogen oxide generation amount-determining means with a predetermined amount slightly smaller than a maximum amount that said nitrogen absorbent can absorb, and determines that said amount of nitrogen oxides absorbed by said nitrogen oxide absorbent has been saturated when said amount of nitrogen oxides generated within said engine becomes equal to or larger than said predetermined amount.

7. An exhaust gas-purifying system as claimed in claim 1, further including reduction means for reducing nitrogen oxides absorbed by said nitrogen oxide absorbent, by enriching an air-fuel ratio of a mixture supplied to said engine, said reduction means being operable when said saturation state-determining means determines that said amount of nitrogen oxides absorbed by said nitrogen oxide absorbent has been saturated.

* * * * *